US009409639B1

(12) United States Patent
Kovalenko

(10) Patent No.: US 9,409,639 B1
(45) Date of Patent: Aug. 9, 2016

(54) METHOD AND SYSTEM FOR PROTECTION OF VESSELS AGAINST INTRUSIONS

(71) Applicant: Vladimir S. Kovalenko, Moscow (RU)

(72) Inventor: Vladimir S. Kovalenko, Moscow (RU)

(73) Assignee: Vladimir S. Kovalenko, Moscow (RU)

( * ) Notice: Subject to any disclaimer, the term of this patent is extended or adjusted under 35 U.S.C. 154(b) by 0 days.

(21) Appl. No.: 14/545,905

(22) Filed: Jul. 6, 2015

Related U.S. Application Data

(60) Provisional application No. 62/178,205, filed on Apr. 2, 2015.

(51) Int. Cl.
*B63G 1/00* (2006.01)
*B63G 13/00* (2006.01)

(52) U.S. Cl.
CPC ..... *B63G 13/00* (2013.01)

(58) Field of Classification Search
CPC ..... B63G 13/00; B05B 3/0422
See application file for complete search history.

(56) References Cited

U.S. PATENT DOCUMENTS 5,984,203 A * 11/1999 Rosenberg ..... B05B 3/0422 239/222.11

FOREIGN PATENT DOCUMENTS

WO WO 2010/087777 * 8/2010 ..... B63G 13/00

* cited by examiner

*Primary Examiner* — Stephen Avila

(57) ABSTRACT

A method and system for creating a water wall around the perimeter of a ship by pumping a high-pressure water stream through a plurality of rotational water dispensing heads positioned around the perimeter of the ship. Each of the water dispensing heads produces a water circle and the overlapping water circles create a water wall around the ship that cannot be broken by the intruders attempting to approach the ship and to climb on board. Each water heads has several jets dispensing water streams under high pressure. The water heads rotate under an impact of the water streams coming at an angle from the water dispensing jets. Thus, the entire boat is covered by a continuous water wall barrier, which does not allow for any intrusion attempts from another boat or from a pier.

14 Claims, 11 Drawing Sheets

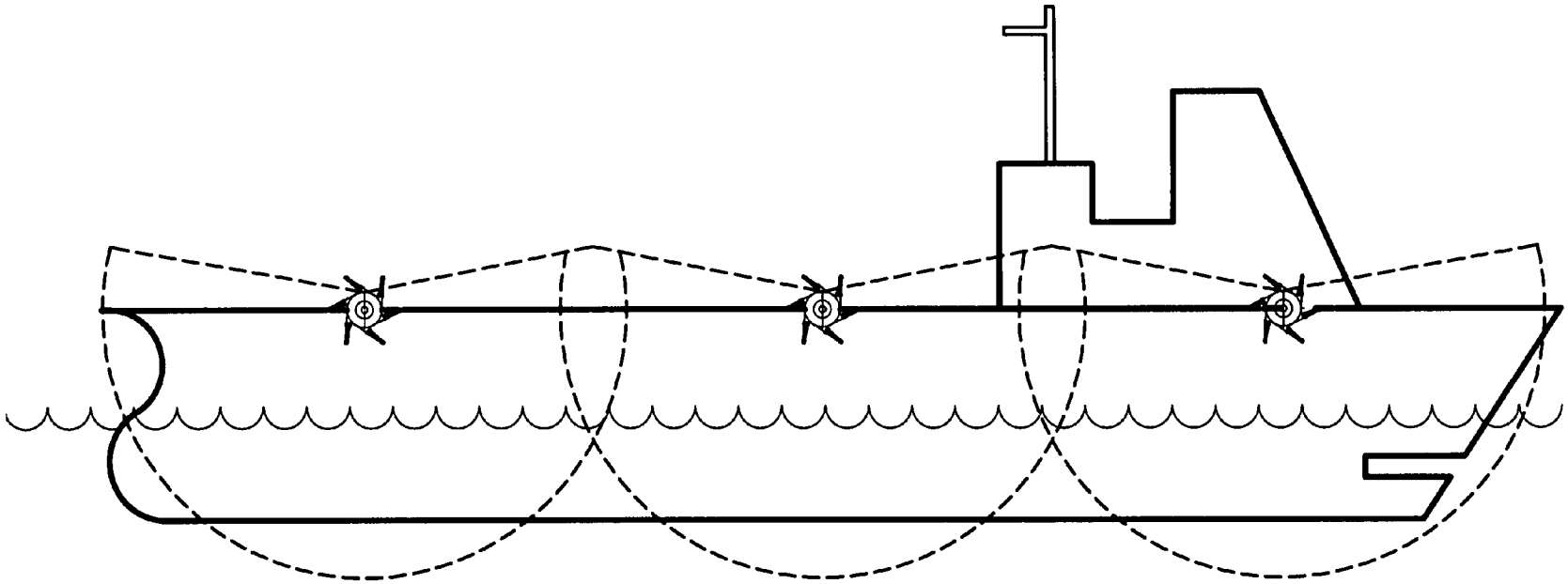
FIG. 8.1.

METHOD AND SYSTEM FOR PROTECTION OF VESSELS AGAINST INTRUSIONS

CROSS-REFERENCE TO RELATED APPLICATION

This application is a non-provisional application of U.S. Provisional Patent Application No. 62/178,205 filed Apr. 2, 2015, entitled A DEFENSE SYSTEM FOR MARINE AND RIVER VESSELS AGAINST THE INTRUSION OF UNAUTHORIZED PERSONS ON BOARD, incorporated by reference herein in its entirety.

BACKGROUND OF THE INVENTION

1. Field of the Invention

This invention relates to a vessel anti-piracy' protection system and, in particular, to a method and system for creating a water wall barrier around the perimeter of the vessel in order to prevent the pirates or other intruders from approaching the vessel and getting on board.

2. Description of the Related Art

Modern maritime piracy has become a very serious problem with more than 400 attacks recorded in 2010 and 2011. The numbers of reported attacks have decreased slightly over the resent years, but protection of merchant and passenger boats and vessels remains a serious problem that exists on an international scale. This problem has not been solved because of the maritime international laws prohibiting use of weapons or presence of armed guards on board of merchant and passenger ships. Other protection means such as protection of the perimeter of the ship with barb-wire fences are used, but they are costly and ineffective against pirates who can approach the vessel in large boats and throw up hooks and ladders and climb on board regardless of the fences. The barbed fences need to be installed at a high cost and not every commercial ship owner is willing to spend money on the security modifications of his ship. In 2014 only, the world community had spent 8 billion of US dollars in order to protect cargo and passenger ships from pirate attacks with a minimal success.

Some companies use water guns positioned on board of a ship for protection against pirates. While the water guns or canons can assist in protecting a ship to some degree, they are proven to be ineffective in cases when a massive pirate attack occurs. In these cases, some of the pirates can get on board by avoiding the water guns. They can take control of the ship and turn off the water guns so the rest of the gang can board the ship.

Accordingly, a method and system for efficient and inexpensive protection of a vessel against pirates or intruders is desired. It is also desired to have an anti-piracy system that does not require any modifications to the existing vessel structures.

SUMMARY OF THE INVENTION

This invention relates to vessel protection against pirates and, in particular, to a method and system for creating a continuous water wall barrier around the perimeter of the vessel in order to prevent pirates or other intruders from approaching the vessel and getting on board that substantially overcomes one or more disadvantages of the related art.

The present invention is directed to a method and system for creating a water wall barrier around the perimeter of a ship by pumping a high-pressure water stream through a plurality of rotational water dispensing heads positioned around the perimeter of the ship. Each of the water dispensing heads produces a water circle and the overlapping water circles create a water wall barrier around the ship that cannot be breached by the intruders attempting to approach the ship and to climb on board. Each water head has several jet nozzles dispensing water streams under high pressure. The water heads rotate under a reactive force impact of the water jet streams coming at an angle from the water dispensing jet nozzles. Thus, the entire boat is covered by a continuous water wall barrier, which does not allow for any intrusion attempts from another boat, from air or from a pier.

Additional features and advantages of the invention will be set forth in the description that follows, and in part will be apparent from the description, or may be learned by practice of the invention. The advantages of the invention will be realized and attained by the structure particularly pointed out in the written description and claims hereof as well as the appended drawings.

It is to be understood that both the foregoing general description and the following detailed description are exemplary and explanatory and are intended to provide further explanation of the invention as claimed.

BRIEF DESCRIPTION OF THE ATTACHED FIGURES

The accompanying drawings, which are included to provide a further understanding of the invention and are incorporated in and constitute a part of this specification, illustrate embodiments of the invention and together with the description serve to explain the principles of the invention.

Figure 8:
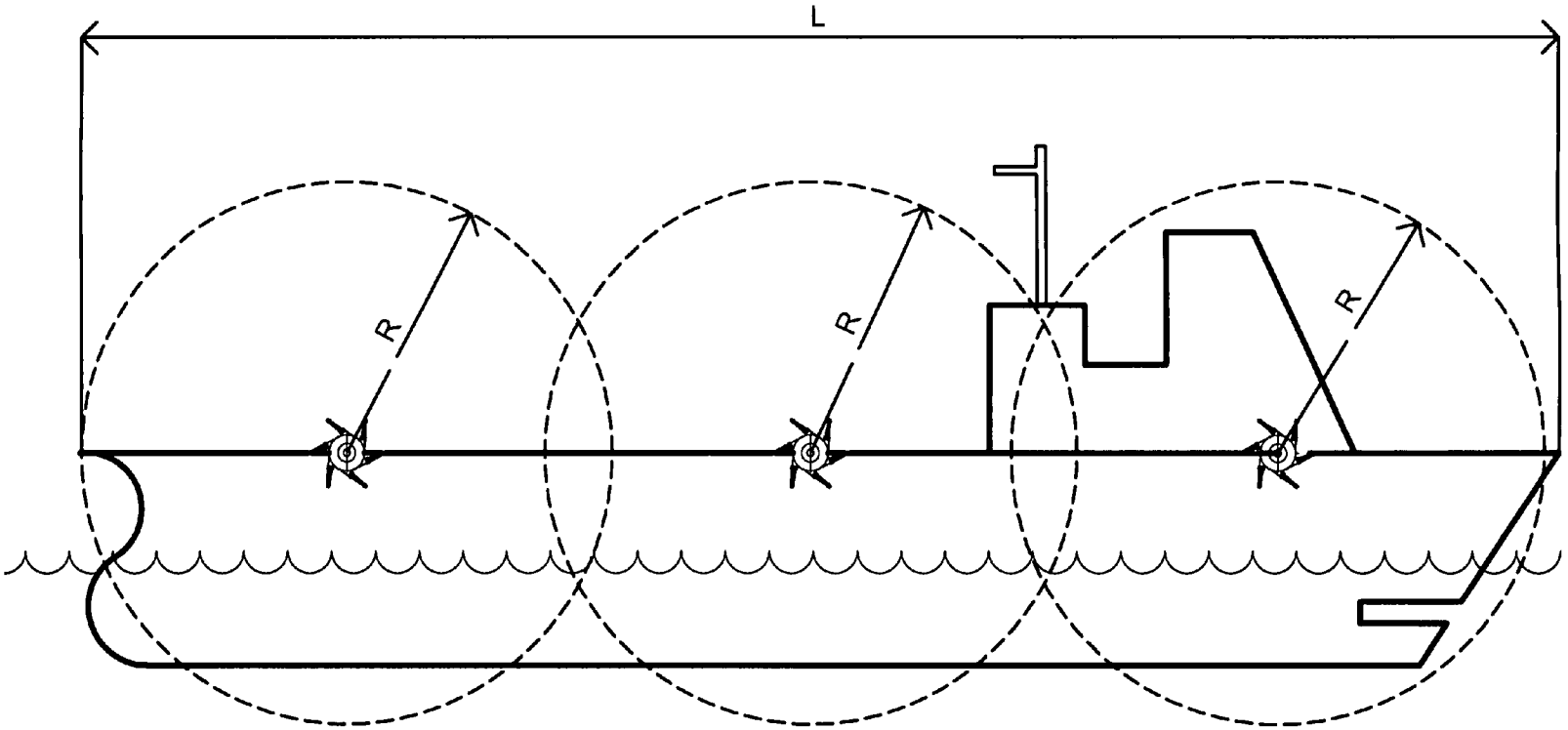
FIG. 8 illustrates a water wall formed by intersecting circles, in accordance with the exemplary embodiment.
Figure 9:
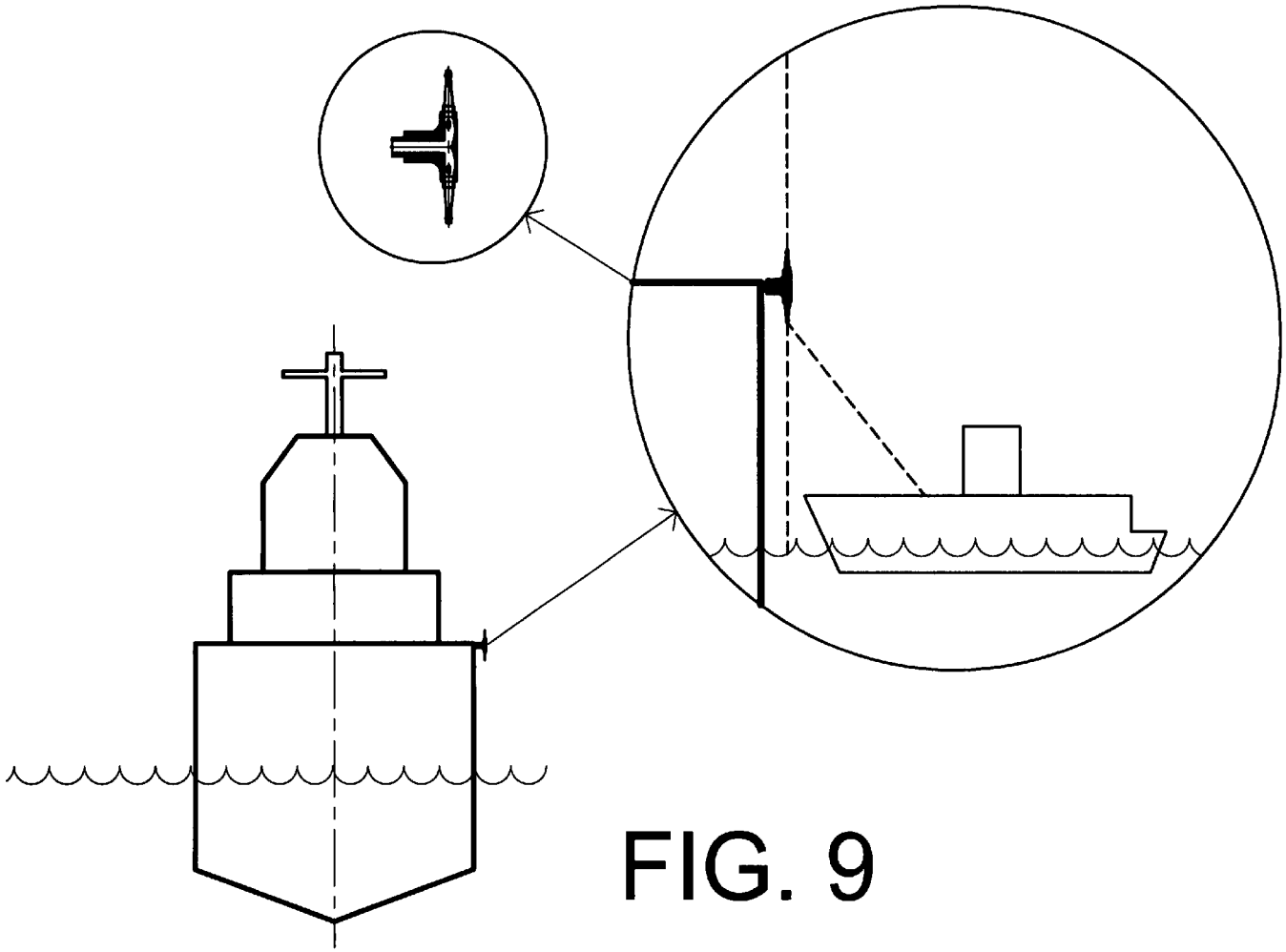
Figure 10:
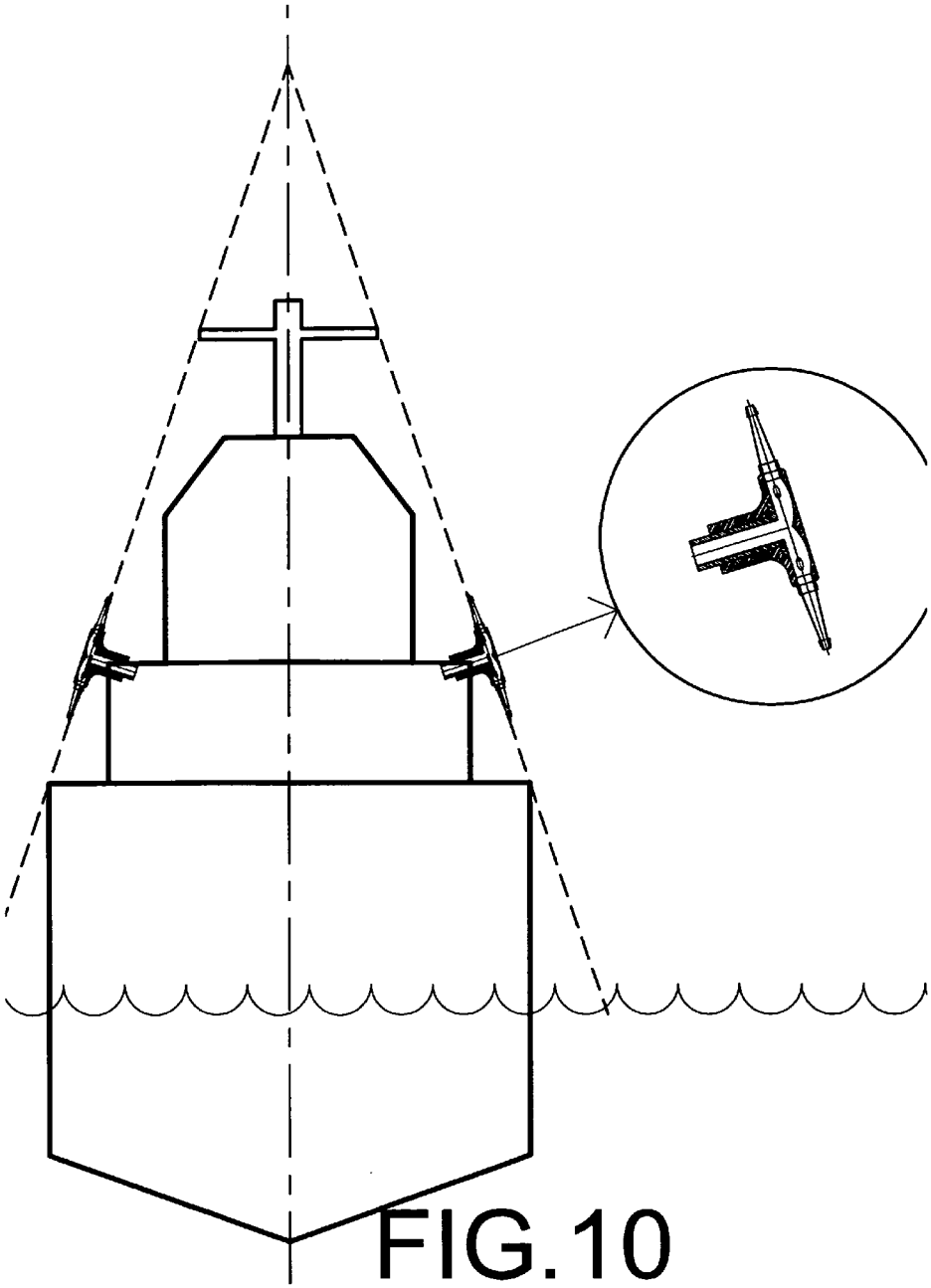

FIG. 8.1 illustrates truncated water wall circles, in accordance with the exemplary embodiment;

FIG. 9 illustrates creation of two water walls by alternating straight and angled jet nozzles of the multipronged heads, in accordance with the exemplary embodiment;

FIG. 10 illustrates an A-shaped shield created by the multipronged heads positioned at a certain angle, in accordance with the exemplary embodiment.

DETAILED DESCRIPTION OF THE PREFERRED EMBODIMENTS

Reference will now be made in detail to the preferred embodiments of the present invention, examples of which are illustrated in the accompanying drawings.

The present invention is directed to a method and system for creating a continuous water wall around the perimeter of a ship by pumping a high-pressure water stream through a plurality of rotational water dispensing heads positioned around the perimeter of the ship. Each of the water dispensing heads produces a water circle and the overlapping water circles create a water wall barrier around the ship that cannot be breached or broken by the intruders attempting to approach the ship and to climb on board.

Each water head has several jet nozzles dispensing water streams under a high pressure. The water heads rotate under an impact of the reactive force created by the water jet streams coming at an angle from the water dispensing nozzles. Thus, the entire boat is covered by a continuous water wall barrier, which does not allow for any intrusion attempts from another boat, from a pier or from air. Herein, for the purpose of this description the water wall system is referred to as a "Water Fort."

Figure 1:
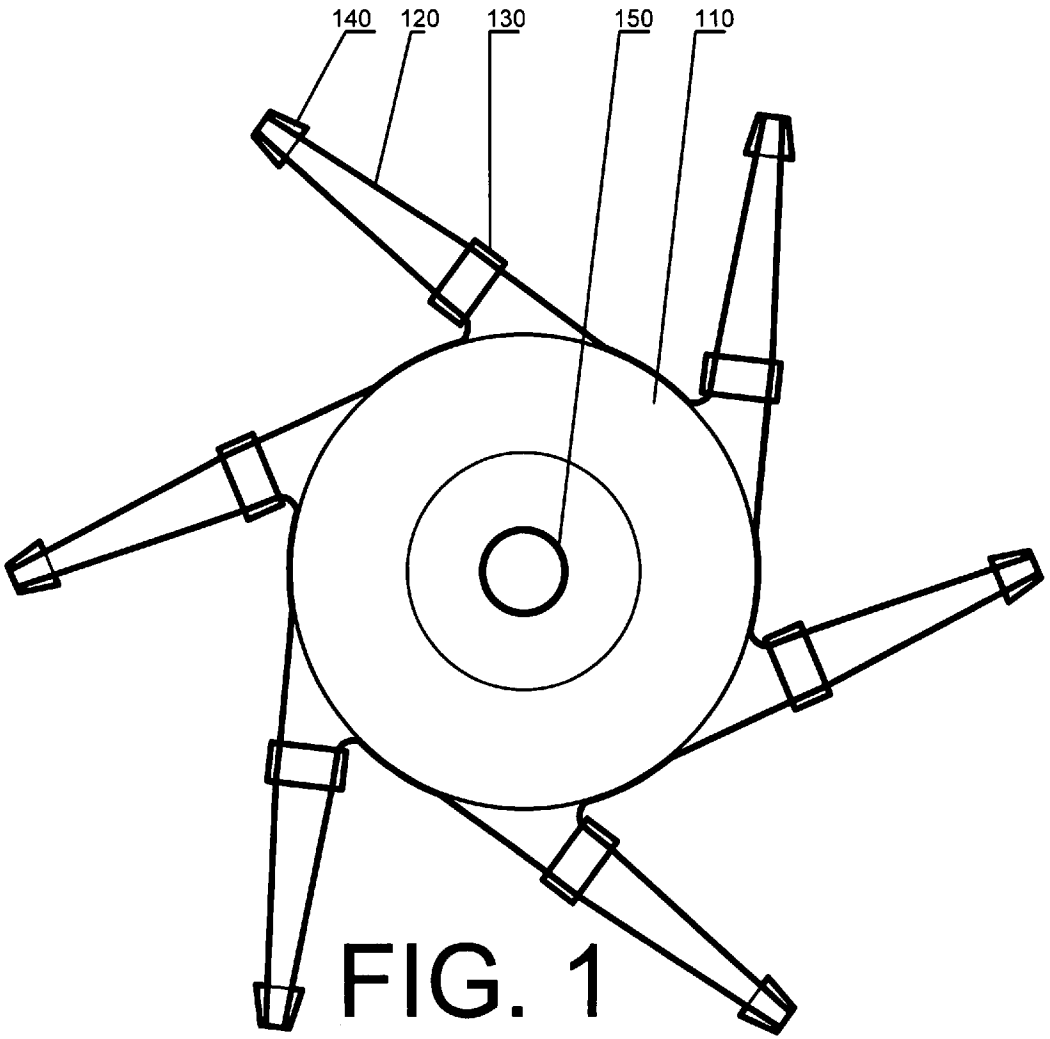
FIG. 1 illustrates a top view of a multipronged head, in accordance with the exemplary embodiment.
Figure 6:
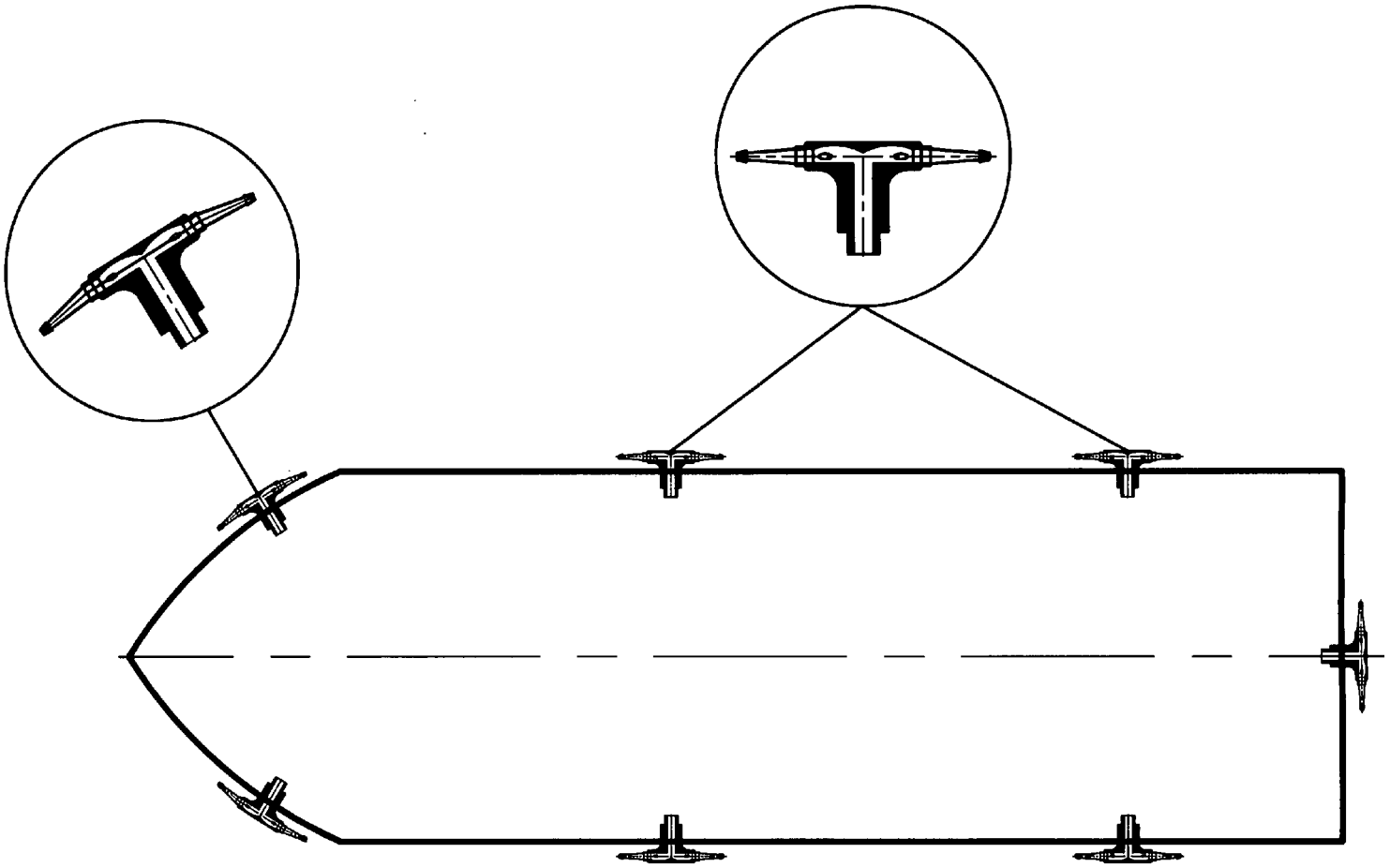
FIG. 6 illustrates a top view of positioning of the multipronged heads along the perimeter of the vessel, in accordance with the exemplary embodiment.
Figure 7:
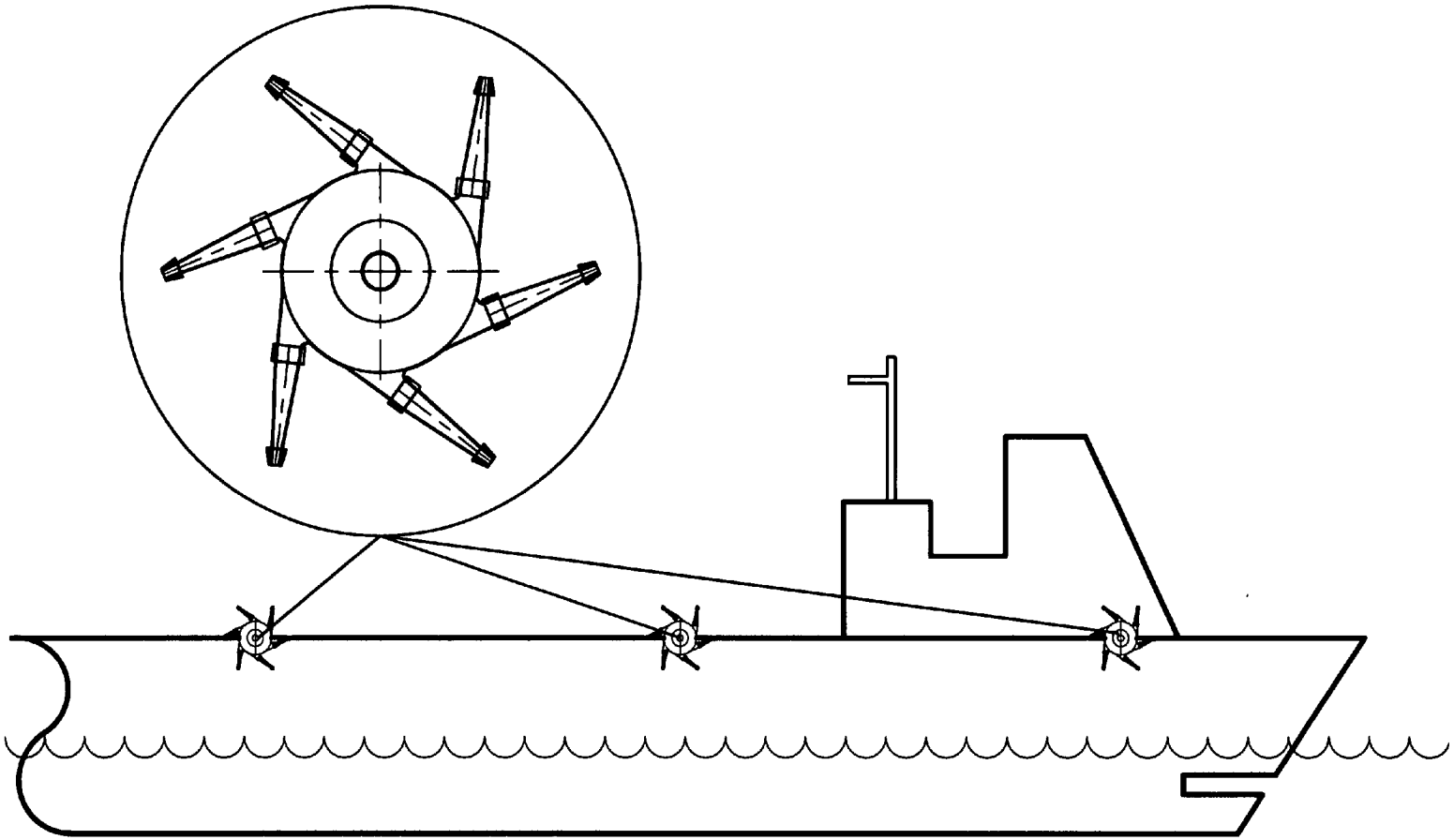
FIG. 7 illustrates a side view of positioning of the multipronged heads along the perimeter of the vessel, in accordance with the exemplary embodiment.

According to an exemplary embodiment, the Water Fort system includes a plurality of rotating water dispenser heads located along the perimeter of the boat as shown in FIGS. 6 and 7. An assembly of a single water dispenser head is illustrated in FIG. 1. The water head dispenser includes a flat cylindrical base water head container 110 made from a hard metal capable to withstand a high-pressure created inside the base water head container 110. The inner surface of the base water head container 110 is polished in order to minimize friction and loss of pressure of turbulent water streams entering the base water head container 110 under high-pressure.

Figure 2:
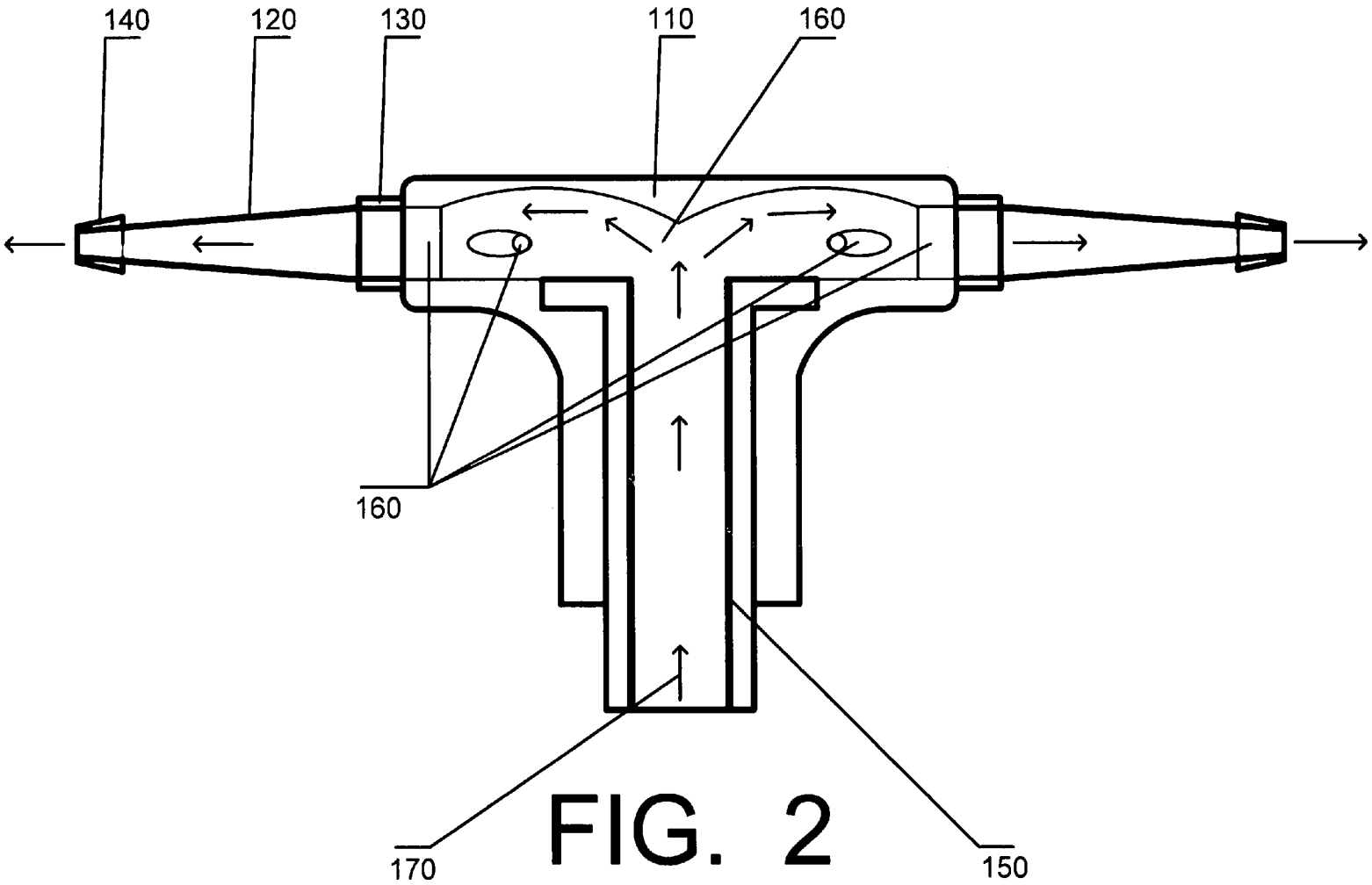
FIG. 2 illustrates a side cross section view of a multipronged head, in accordance with the exemplary embodiment.

The base water head container 110 has a water input 150 for connecting a high-pressure hose or water pipe, which provides a continuous water stream 170 from a main water pump as shown in FIG. 2 depicting a side view of the water head. Note that the conventional ship water pump is advantageously used. The base water head container 110 is connected to the high pressure pipe (or hose) by means of flanges in such a way that the base water head cylinder 110 can rotate about its axis. In order to reduce rotational friction, bearings or special rotational spacer rings can be used inside the flanges. Note that the dimensions of the water dispensing head unit (i.e., a height and a diameter of the base water head container 110) are calculated for each particular ship based on a required number of high-pressure water jet nozzles 120 placed on the surface of the cylinder of the water head container 110. The length of the surface area of the water head container 110 depends on a radius of the cylinder.

According to one exemplary embodiment, the water head 110 can have 4 to 6 high-pressure water jet nozzles 120. However, an arbitrary number of the jet nozzles can be used based on a volume of the water head cylinder, which can be calculated as:

$$V=\pi r^2 H$$

where r—radius of the cylinder and H—height of the cylinder. The water head with 4-6 jet nozzles creates a water wall positioned in a vertical plane. If the water head has a larger radius r, more jet nozzles can be attached at different angles (see FIG. 4 right drawing). This embodiment can produce several water wall barriers positioned in different planes as shown in FIG. 9, which is discussed in more detail herein. Additionally, the water spraying nozzles can be used for creation of a mist cloud. According to one embodiment, some of the jet nozzles can dispense colored water for additional protection of the vessel. Note that since the proposed system uses the standardized jet nozzles 120 and the connection couplings 130, the size of the water head is selected to accommodate a desired number of the jet nozzles for a particular vessel.

A number of the water head required for protection of an entire perimeter of a vessel is determined by the size of the vessel and a vessel pump capacity. The number of the required water heads can be determined as follows:

$$M=(L*H)/\text{MPa},$$

where M is a number of the water heads, L—length of a vessel, H—height of the walls of the vessel above the water, MPa—a pressure of a water jet coming out of a jet nozzle. The produced water jets have significant length of a compact effective portion of the jet. For example, if the water jet pressure is 10 MPa, and the diameter of the jet is 30 mm, the effective portion of the jet can dismantle a body of an intruder at a distance of up to 50 m form the jet nozzle. At pressure of 90 MPa, a water jet of the diameter of 20 mm can cut Granite rocks. A diameter of a protected area can be in a range from 100 to 130 m. Consequently, in order to protect a vessel of 300 m in length, only 7 water heads are required (see FIG. 6).

According to the exemplary embodiment, the base water head container 110 has water passages 160 located on the outer part of the cylinder of the base water head 110 at equal distances from each other for dispensing the water stream 170 into water jet nozzles 120. A number of the high-pressure water jet nozzles 120 are selected based on the diameter of the cylinder of the base water head 110. The high-pressure water jet nozzles 120 are connected to the cylinder of the water head base 110 by connection couplings 130 that provide for very fast and easy attachment (or detachment) of the high-pressure water jet nozzles 120.

The high-pressure water jet nozzles 120 form continuous compact water jet streams of a pre-defined diameter and a pre-determined shooting range. The jet streams are formed from a turbulent water stream created inside the water head base cylinder 110. According to one embodiment, special jet heads 140 are placed onto the water jet nozzles 120 in order to produce a water spray instead of a compact jet stream. According to one embodiment, the water jets can be replaced by a spray with a pre-set periodicity in order create a masking water mist around the perimeter of the ship.

According to the exemplary embodiment, the connection quick-release adjustable couplings 130 are implemented in such manner that the water jet nozzles 120 can be attached at a certain angle (see FIG. 4) in order to accommodate a shape of the vessel as shown in FIG. 6. Thus, the created water wall barrier wraps up the contour of the ship more closely. The horizontal and vertical angles of the positioning of the water jet nozzles 120 are calculated for a particular ship and can be changed almost on-the-fly if it is required by the situation (i.e., waves, weather condition, visibility, etc.). Alternatively, the angled water jet nozzles 120 can replaced by the straight ones and vice versa as shown in FIG. 6.

Figure 4:
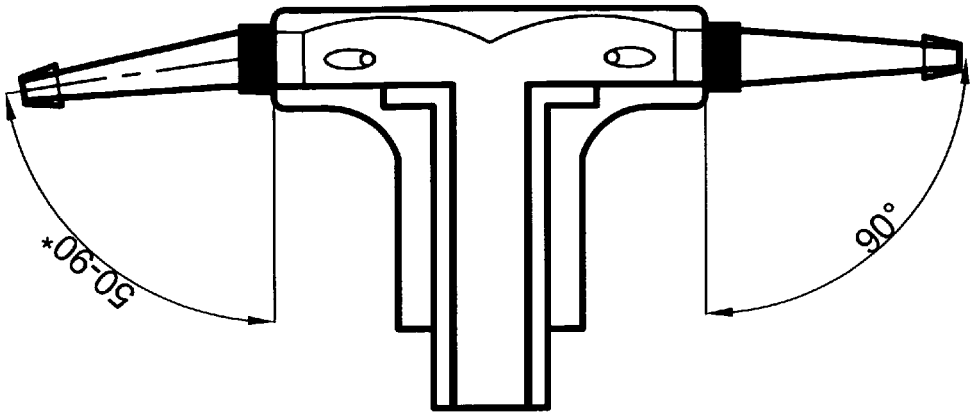
FIG. 4 illustrates a positioning of water jet nozzles on the multipronged head; in accordance with the exemplary embodiment.
Figure 4:
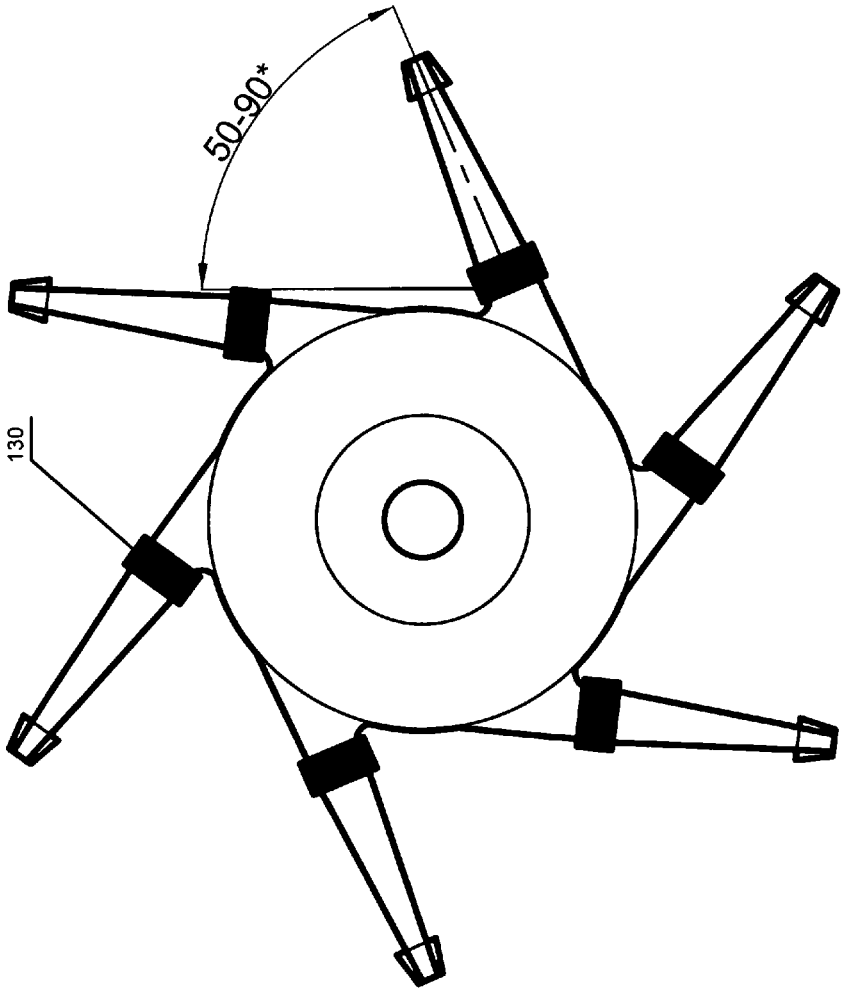

According to on exemplary embodiment, the straight and angled water jet nozzles 120 can be alternated on the water head 110 as shown in FIG. 4. The quick-release adjustable couplings 130 allow for quickly changing the angles of jet nozzles as dictated by the situation. Thus, this embodiment produces two different water walls—one is vertical (i.e., parallel to the side of the ship) and one positioned at an angle to the side of the ship as shown in FIG. 9 (see large circle). According to the exemplary embodiment, the angled water wall servers as an attacking tool against the pirate boats (see a boat shown inside the right circle) attempting to approach the side of the ship. Additionally, some of the water jet nozzles 120 can be equipped with the jet heads 140 placed onto their tips for producing a high-pressure water spray, which ultimately creates a mist (or a cloud) around the ship.

This way the ship is protected in three different ways—i.e., it is made to be virtually invisible by the mist cloud; it has an angular water wall for preventing the intruders from approaching the ship and the vertical water wall making it impossible for the intruders to climb on board. This triple protection makes the Water Fort a very efficient and reliable system for protection of the ship against the intruders.

Figure 3:
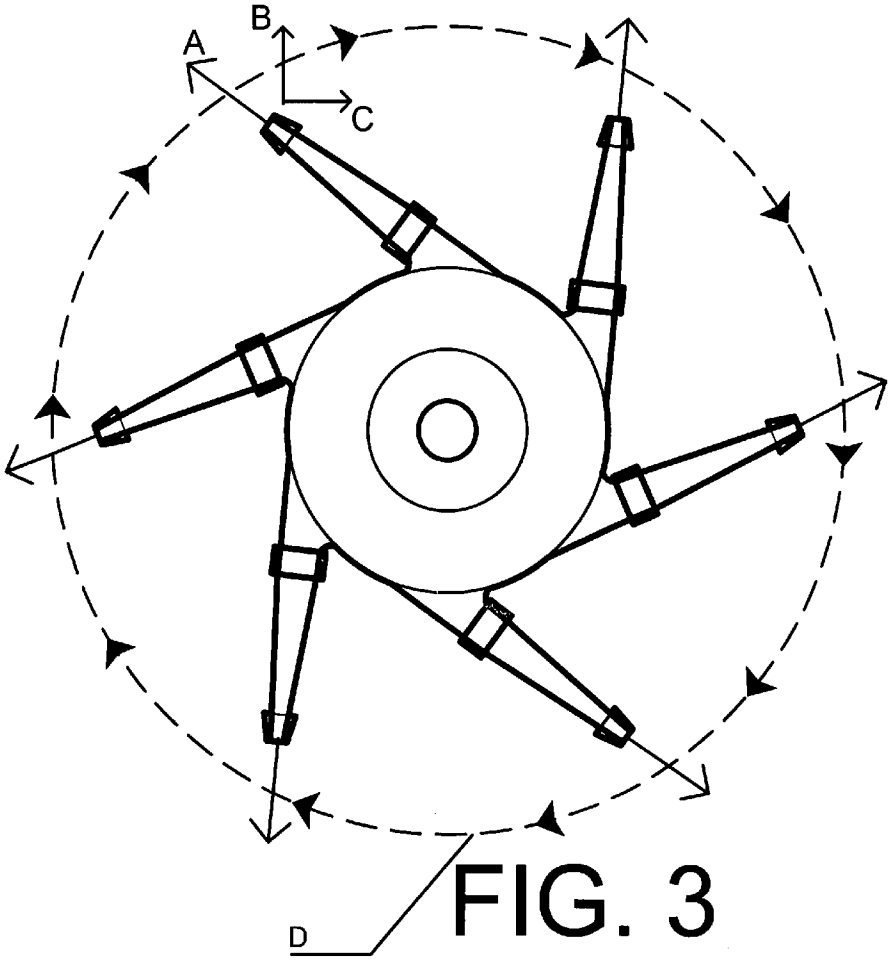
FIG. 3 illustrates how the multipronged head rotates under the impact of the reactive forces produced by jet streams, in accordance with the exemplary embodiment.

According to the exemplary embodiment, all water jet nozzles 120 are attached to the base cylinder 110 at an angle to diameter line of the base cylinder by quick-release adjustable couplings as shown in FIG. 3. Therefore, the water jet streams A coming out of the jets 120 create a pressure force B and reactive force C that produce a resulting force which cause rotation of the base cylinder 110 with the water jet nozzles 120 in a clockwise direction.

In order to create a sufficient reactive force, the jet nozzles are positioned at an angle to the diameter of the water head cylinder as shown in FIG. 4. The higher the angle of the jet nozzles, the faster is the angular velocity of the water head unit. The higher is the side wall of the ship (over the water), the faster rotation (angular velocity) of the water head is needed so the water jets cross over the potential intrusion point more frequently. For example, the same ship can have a height of the walls over the water 6-8 m under cargo load and can have the height of the walls over the water 20-25 m when it is empty. This can be accommodated by the quick-release adjustable couplings 130 (FIG. 2) that can change the angles of the jet nozzles 120 and thereby control the angular velocity of the rotating water heads required for protection of the particular vessel in its current loaded or unloaded state.

As discussed above, the rotation at a high rate of angular velocity creates a monolith water circle of a set range R as shown in FIG. 8. Note that the overlapping water circles produce the protective water wall barrier—i.e., a Water Fort, which cannot be breached by the intruding pirates, providing that the water pressure is sufficient.

In order to implement the water wall barrier around the perimeter of the ship, a number of the water dispensing units (i.e., water heads) are placed on the deck along the edges of the ship as shown in FIG. 6 depicting the top view and FIG. 7 depicting the side view. According to one exemplary embodiment, in order to improve the effectiveness of the Water Fort system and to reduce water usage, the water circles depicted in FIG. 8 are truncated (i.e., flattened out) as shown in FIG. 8.1. This is particularly important in terms of a view field available to the captain and the crew on board. The flattened out water walls allow for monitoring maneuvers of the pirates in order to adjust the positioning of the water jet nozzles using quick-release couplings according to the situation. It also helps to navigate the ship in tight spaces and when being docked at the ports or at a pier.

Figure 5:
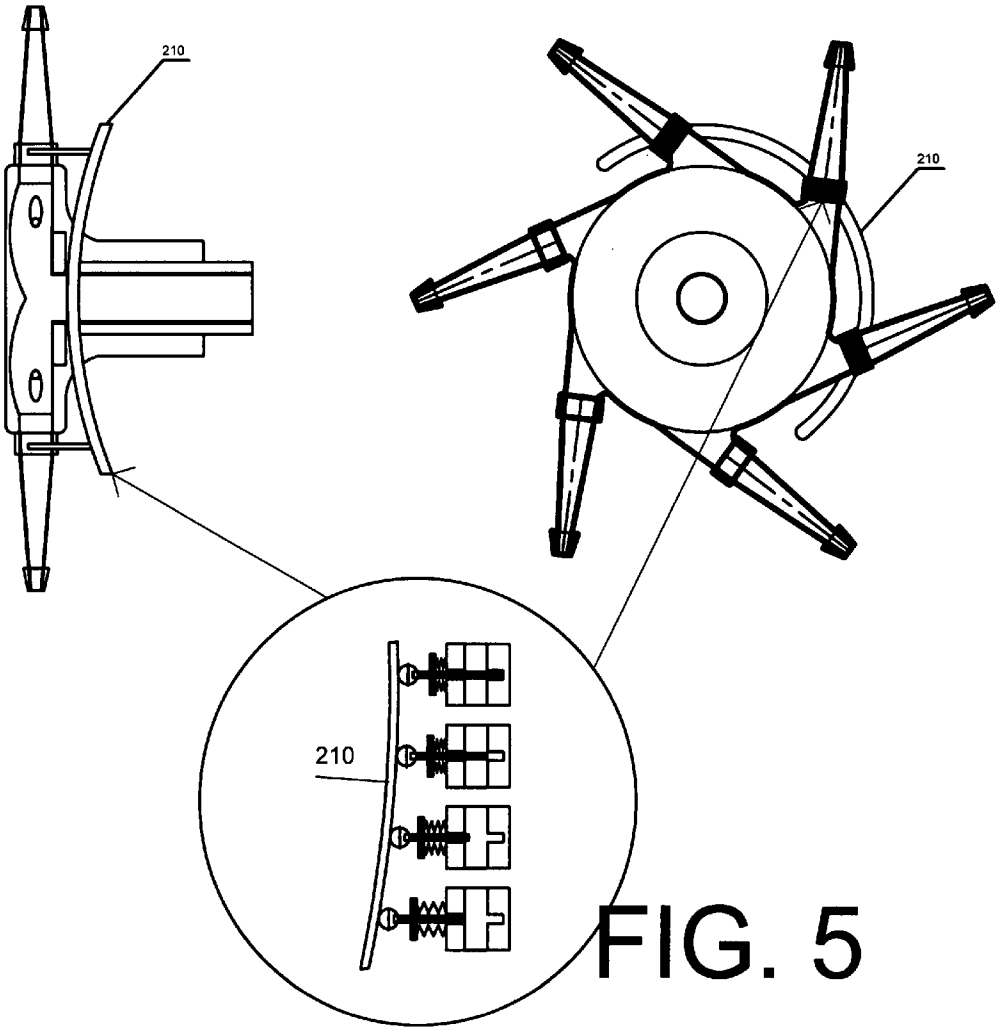
FIG. 5 illustrates a mechanism for blocking a water stream in the water jet nozzles based on their positioning, in accordance with the exemplary embodiment.

This is accomplished by a locking device 210 attached to the connection couplings 130 as shown in FIG. 5. The locking device in a form of a valve blocks the water jet stream once the water jet 120 moves to a certain position above the horizon line. Once the water jet passes 120 the horizon line, the valve opens and the water jet stream comes out creating a lower portion of a water wall circle depicted in FIG. 8.1. Thus, the upper portion of the water circle is eliminated (see FIG. 8.1), advantageously, saving some water and making the Water Fort more efficient and less costly. According to one implementation of the Water Fort system, the water jet nozzles 120 can be located on the upper deck of the vessel positioned at a certain angle as shown in FIG. 10. This implementation can be used for producing a layer of a sick cloud of mist around the entire ship including the masts, antennas and the captain's cabin.

This implementation basically masks or hides the ship and makes it impossible for the pirates to shoot at the ship even from a close range. In this mode of the operation, the heads 140 (see FIG. 2) are attached to the tips of jet nozzles 120 in order to produce a dispersed water spray instead of a compact jet stream. According to the exemplary embodiment, the Water Fort system uses the vessels' existing pumping equipment or, optionally, installed additional pumps. The Water Fort system is very efficient, as it uses the sea water surrounding the vessel by pumping the water through a high intensity multiport head.

An arbitrary number of the water jet nozzles can be used, for example, between 4 and 30 based on a capacity of the pump. According to the exemplary embodiment, the Water Fort heads are placed 15 to 25 cm from the side of the of the vessel (see FIG. 6) in order to create a virtually impenetrable wall of water around the vessel. The Water Fort heads can be placed at different locations and at different angles along the perimeter of the vessel creating multiple water walls. This not only prevents the intruders from scaling the walls of the vessel, but by placing the Water Fort heads anywhere from 1 to 10 meters from the side of the vessel, can also prevent the intruders from getting close enough to the vessel in order to shoot at the persons on board or to throw a grenade.

As discussed above, by replacing the high intensity nozzles with lower intensity (or by changing the heads of the nozzles) and positioning the spray nozzles at a different angle, the Water Fort system can create a cloud-like (mist) wall all around the vessel, thus reducing the visibility to the potential intruders and reducing their ability to maneuver their boats near the vessel being protected. To increase the effectiveness of the Water Fort system, the multipronged water dispensing head can be fitted with a "floating" variable axis, creating unpredictable streams of water and angles of the water walls all around the vessel, making it even harder for potential intruders to plan their attack.

In the event of an attack from the air (such as an unauthorized helicopter landing), the Water Fort multipronged heads can be placed at angle as shown in FIG. 10. This will result in an A-shaped water shield all around the vessel for preventing the vessel from intrusion from air such as an unauthorized helicopter landing. By placing both the high-intensity jet nozzles and low-intensity spray nozzles at the upward angle, an additional barrier in the form of a "water cloud" can be created for shielding the vessel from the aerial view. This implementation can be especially useful for military applications, for the purpose of covert movement of the individual vessels of various sizes.

According to the exemplary embodiment, the Water Fort System, advantageously, has a high reliability employing high-intensity water streams capable of breaking rock formations. The Water Fort system employs high and low intensity jet streams forming a variety of water barriers around the vessel. These barriers make it impossible for an intruder to scale the outer walls of the vessel.

Employing the multipronged heads at an appropriate angle, makes it extremely difficult for attacking boats to approach the vessel, and practically impossible for them to dock to the protected vessel. Employing the lower-intensity spray nozzles creates a "water cloud" barrier, which provides for an additional defense against arial attacks by impairing visibility, as well as reducing the mobility of the intruding forces.

The proposed Water Fort system, advantageously, requires little to no special training for the crew members. The system, once set up, can be easily activated by pressing a power button, which starts the flow of water instantly. The Water Fort system can be used a very low cost making it available to the owners of ships of various size and value. The Water Fort System can use standard pumps available on most vessels, such as firefighting pumps, drainage pumps, drinking water pumps and special pumps that only operate during an attack on the vessel. The Water Fort system is equipped with inexpensive, readily commercially available nozzles and parts, used by fire departments all around the world. Additional costs of the system assembly may include the manufacture of the multipronged head, the quick-release adjustable couplings, pipes and the installation of the parts.

Note that one high-pressure fire hose is capable of creating a powerful stream reaching up to 100 meters, for example. One Water Fort high-pressure nozzle can create a powerful jet stream of up to 50 meters, thus creating a circular water barrier with a diameter of 100 meters along the sides of the vessel. Thus, in order to secure the perimeter of the ship of a 300 meters length, only 7 multipronged heads (as depicted in FIGS. 1 and 2) are needed. The Water Fort vessel protection system adheres to all international maritime laws and regulations making it available to be used by any ship owner or a company on any of his fleet.

Having thus described a preferred embodiment, it should be apparent to those skilled in the art that certain advantages of the described method and apparatus have been achieved. In particular, those skilled in the art will appreciate that the proposed anti-piracy vessel system provides an efficient low-cost protection against pirates or other intruders attempting to board the vessel.

It should also be appreciated that various modifications, adaptations, and alternative embodiments thereof may be made within the scope and spirit of the present invention. The invention is further defined by the following claims.

What is claimed is:

1. A system for protection of a vessel against pirates and other intruders, the system comprising:

a plurality of multipronged cylindrical heads configured to dispense high-pressure water jet streams and positioned along a perimeter of the vessel at an equal distance from each other; and a water pump configured to intake a sea water and provide a high-pressure water stream to the multipronged heads connected to the pump through a high-pressure hose, wherein:

the multipronged cylindrical heads comprise a plurality of water jet nozzles located at an equal distance from each other and configured to dispense compact high-pressure water jets produced from a turbulent water stream incoming into the multipronged cylindrical heads from the pump;

each of the multipronged cylindrical heads is configured to rotate about its axis under an impact of a reaction force produced by the jet streams coming from the water jet nozzles, thereby producing a continuous water circle barrier along a side of the vessel;

each of the rotating multipronged cylindrical heads has an integrated valve configured to block a jet stream once a water jet nozzle reaches a position above a horizontal level and to unblock the jet stream once the water jet nozzle reaches the horizontal level again after making a half circle about an axis of the cylindrical head, wherein the valve flattens out an upper half of a water circle barrier; and the multipronged cylindrical heads comprise a plurality of alternating straight and angled water jet nozzles adjusted by quick-release couplings for producing a vertical water wall and a water wall located at an angle to a side of the vessel.

2. The system of claim 1, wherein rotating multipronged cylindrical heads are positioned in such a way that a plurality of water circles produced by the rotating multipronged cylindrical heads intersect with each other creating a continuous water wall barrier along the perimeter of the vessel.

3. The system of claim 1, wherein the multipronged cylindrical heads comprise a plurality of the water jet nozzles equipped with jet nozzle heads configured to dispense a high-pressure water spray for creating a cloud of mist around the vessel.

4. The system of claim 3, wherein the multipronged cylindrical heads comprise a plurality of alternating straight, angled and spraying water jet nozzles configured to simultaneously produce a vertical protective water wall barrier and a water wall located at an angle to a side of the vessel for attacking an approaching boat and a cloud of mist for masking the vessel.

5. The system of claim 1, further comprising a plurality of the multipronged cylindrical heads positioned on an upper deck of the vessel at an angle to side board of the vessel for producing at least two water walls intersecting each other above the vessel.

6. The system of claim 5, wherein the intersecting water walls create an A-shape shield covering the entire vessel and preventing intrusion from air such as an unauthorized helicopter landing.

7. The system of claim 1, wherein parameters of the multipronged cylindrical heads are selected based on a length of the vessel and a height of walls of the vessel above water.

8. The system of claim 1, wherein each of the rotating multipronged cylindrical heads is attached to the high-pressure hose by means of flanges having bearings for reducing rotational friction.

9. A method for protection of a vessel against pirates and other intruders, the method comprising:

placing a plurality of rotational multipronged cylindrical heads equipped with a plurality of jet nozzles along a perimeter of the vessel at an equal distance from each other;

connecting the multipronged cylindrical heads to a high-pressure water pump by high-pressure hoses;

activating the high-pressure water pump on board of the vessel, wherein the pump is configured to intake sea water;

pumping the water into the rotational multipronged cylindrical heads; and generating a plurality of compact jet streams by the jet nozzles located on the multipronged cylindrical heads;

producing a continuous water wall barrier formed by a plurality of intersecting water circles generated by the rotating multipronged cylindrical heads that dispense high-pressure compact water jets;

eliminating an upper portion of the water circles by activating a valve configured to lock the jet nozzles once they reach a horizontal plane; and installing spray heads on a plurality of the jet nozzles for producing a cloud of mist around the vessel for making the vessel invisible to the intruders.

10. The method of claim 9, wherein each of the rotational multipronged cylindrical heads rotates about its axis under an impact of a reaction force produced by jet screams coming out of the jet nozzles positioned at an angle to a diameter of the cylindrical heads.

11. The method of claim 9, wherein an angular velocity of the multipronged cylindrical heads is controlled by the angle of the attached jet nozzles.

12. The method of claim 9, further comprising creating the cloud of mist from a colored water.

13. The method of claim 9, further comprising placing the plurality of rotational multipronged cylindrical heads on an upper deck of the vessel along its perimeter at an angle so that at least two water wall barriers create an A-shape shield covering the entire vessel and preventing intrusion from air such as an unauthorized helicopter landing.

14. The method of claim 9, wherein the multipronged cylindrical heads have alternating straight and angled jet nozzles that produce at last two water wall barriers, wherein one water wall barrier is vertical and another water wall comes down at an angle to a side wall of the vessel in order to prevent an intruding boat from approaching the vessel.

* * * * *